US009230456B2

(12) United States Patent
Meyerson et al.

(10) Patent No.: US 9,230,456 B2
(45) Date of Patent: Jan. 5, 2016

(54) DEVICE AND SYSTEM FOR DIFFERENTIATING SPECIFIC LEAD WIRES IN A MULTI-WIRE ENVIRONMENT

(71) Applicant: Mechanical Wonders, LLC, Springfield, VA (US)

(72) Inventors: Susan Elise Meyerson, Springfield, VA (US); Shaun Smith, Harleysville, PA (US); Jeff Theesfeld, Sumneytown, PA (US)

( * ) Notice: Subject to any disclaimer, the term of this patent is extended or adjusted under 35 U.S.C. 154(b) by 0 days.

(21) Appl. No.: 14/207,962

(22) Filed: Mar. 13, 2014

(65) Prior Publication Data

US 2014/0259821 A1 Sep. 18, 2014

Related U.S. Application Data

(60) Provisional application No. 61/794,048, filed on Mar. 15, 2013.

(51) Int. Cl.
*G09F 3/00* (2006.01)
*G09F 3/06* (2006.01)

(52) U.S. Cl.
CPC ..... *G09F 3/06* (2013.01); *G09F 3/0295* (2013.01)

(58) Field of Classification Search
CPC ..... G09F 3/205; G09F 3/0295; G09F 3/16; G09F 3/00
USPC ..... 40/316
See application file for complete search history.

(56) References Cited

U.S. PATENT DOCUMENTS

| | | | | | |
|---|---|---|---|---|---|
| 2,250,469 | A * | 7/1941 | Crow | 24/536 |
| 3,137,027 | A * | 6/1964 | Birkle | 16/87.2 |
| 3,214,810 | A * | 11/1965 | Mathison | 24/536 |
| 3,767,092 | A * | 10/1973 | Garrison et al. | 223/96 |
| 3,950,829 | A * | 4/1976 | Cohen | 211/124 |
| 4,355,743 | A * | 10/1982 | Erthein | 223/96 |
| 4,637,097 | A * | 1/1987 | Secord | 24/16 PB |
| 5,115,586 | A * | 5/1992 | Hawker | 40/316 |
| 5,138,784 | A * | 8/1992 | Niwa | 40/665 |
| 5,157,853 | A * | 10/1992 | Piana et al. | 40/316 |
| 5,361,948 | A * | 11/1994 | Batts | 223/96 |
| 5,474,268 | A * | 12/1995 | Yu | 248/61 |
| 5,957,345 | A * | 9/1999 | Petrou et al. | 223/96 |
| 6,199,728 | B1 * | 3/2001 | Cohen | 223/96 |
| 6,418,595 | B1 * | 7/2002 | Shih | 24/536 |
| 6,651,362 | B2 * | 11/2003 | Caveney | 40/316 |
| 7,086,635 | B1 * | 8/2006 | Drapeau | 248/339 |
| 7,946,244 | B2 * | 5/2011 | Dowler et al. | 116/310 |

(Continued)

OTHER PUBLICATIONS

Evriholder Products, LLC., http://www.evriholder.com/Cable-Clips.asp, Cable Clips Model Number: CCLPS.

(Continued)

*Primary Examiner* — Shin Kim
(74) *Attorney, Agent, or Firm* — Carla Gannon Law

(57) ABSTRACT

An identification system includes a clamshell device that grasps a wire, and a clip that secures the clamshell device in a locked and closed position. The clamshell and/or clip are preferably color-coded to differentiate one wire from another, hereby allowing a technician to easily discern which wire is plugged into which port, and which wire is connected to which patient. The invention is particularly well suited for incorporation with healthcare devices and machines which have long lead wires that reach from the patient to the machine, such as electrical stimulation machines.

17 Claims, 32 Drawing Sheets

(56) References Cited

U.S. PATENT DOCUMENTS

| | | | | |
|---|---|---|---|---|
| 7,963,056 | B1 * | 6/2011 | Mangone, Jr. | 40/316 |
| 8,245,366 | B2 * | 8/2012 | Morejon | 24/457 |
| 8,434,249 | B2 * | 5/2013 | Wieneke | 40/316 |
| 8,516,727 | B1 * | 8/2013 | Maraia | 40/316 |
| 2003/0159257 | A1 * | 8/2003 | Lewis | 24/536 |
| 2009/0160651 | A1 * | 6/2009 | Klein | 340/572.1 |
| 2014/0259821 | A1 * | 9/2014 | Meyerson et al. | 40/316 |

OTHER PUBLICATIONS

DotzShop.Com is a division of Sell Fuse, LLC and is operated out of Minneapolis, MN, http://www.dotzshop.com/, cord identifiers.

* cited by examiner

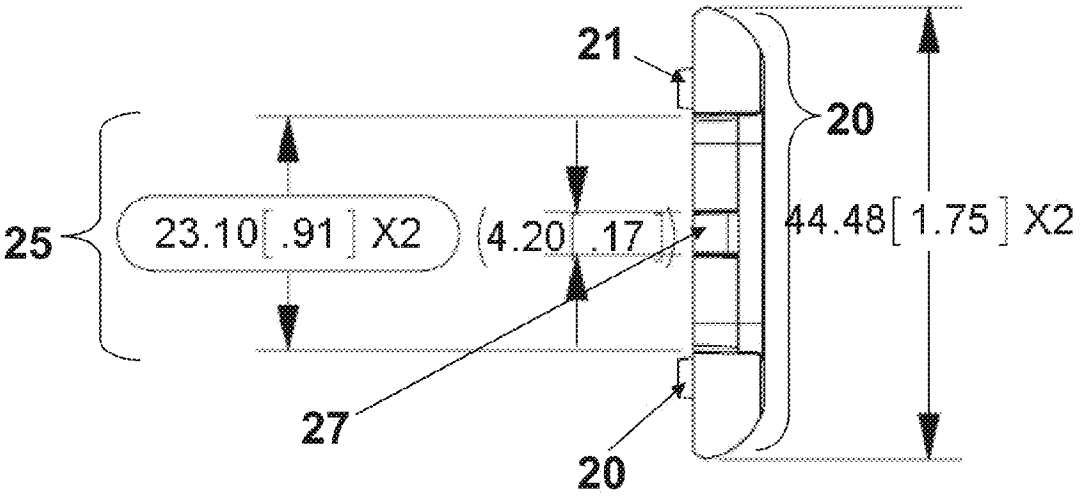

| TOLERANCES UNLESS NOTED [INCHES] |
|---|
| mm .XX = ±.10 .XXX = ±.005 |
| .X = ±.25 .XX = ±.010 |
| ANGLES = ±1° |
| MATERIAL Silicon Rubber |
| WEIGHT 9.12 g |

NOTES:
1. DIMENSIONS SHOWN ARE CRITICAL TO FUNCTION. ALL OTHERS PER ELECTRONIC MODEL
2. COLOR: PANTONE PLASTICS 0520-3 OR APPROVED EQUIVALENT COLOR MATCH
3. TYPICAL DRAFT 1° UNLESS NOTED
4. TYPICAL RADIUS 0.5MM UNLESS NOTED
5. TEXTURE: SPI D-2 LIGHT EDM
6. SURFACE REQUIREMENTS:
   - PART TO BE FREE OF SINKS, VOIDS, AND POROSITY
   - PART TO BE FREE OF OIL, DIRT, OR OTHER SURFACE CONTAMINATION
   - EJECTOR PINS FLUSH TO RECESSED 0.13 OF ANY SURFACE
   - FLASH TO BE FLUSH TO 0.13 FROM ANY SURFACE
   - PARTING LINE MISMATCH: 0.13 MAX
   - GATE, EJECTOR PINS, AND PARTING LINE LOCATIONS REQUIRE ENGINEERING APPROVAL
7. MATERIAL DUROMETER, SHORE A30 +/- 5

FIG. 22

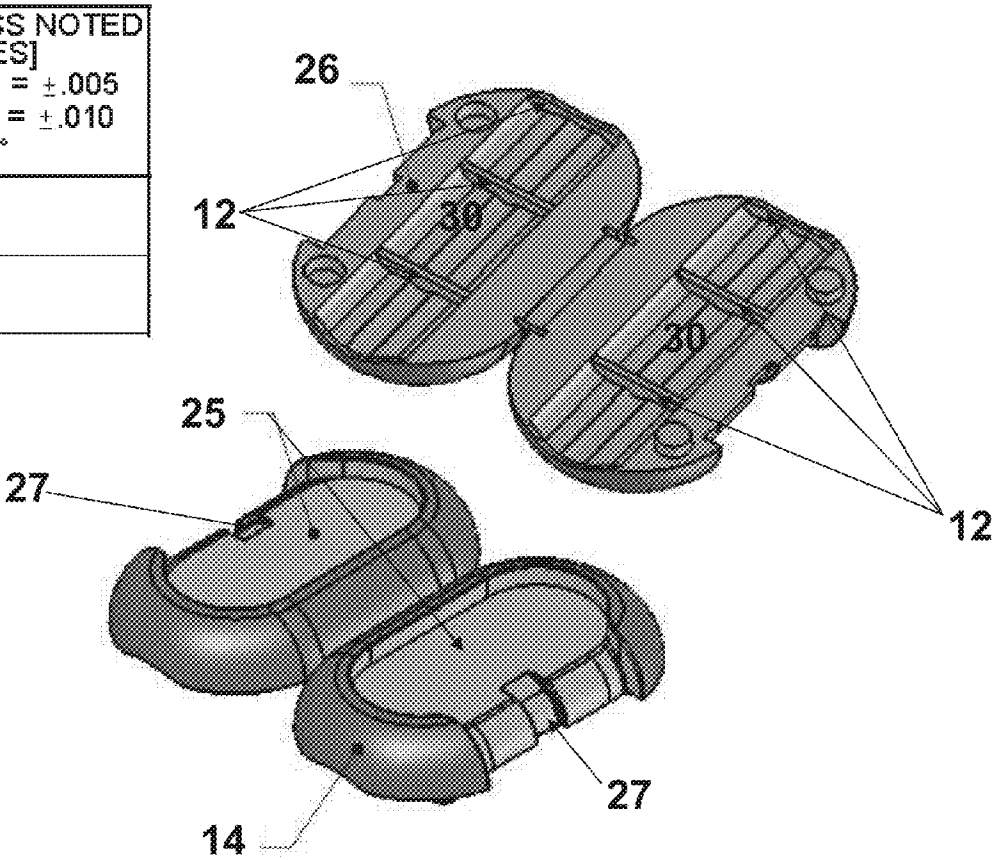

| TOLERANCES UNLESS NOTED mm [INCHES] |
|---|
| .XX = ±.10 .XXX = ±.005 |
| .X = ±.25 .XX = ±.010 |
| ANGLES = ±1° |
| MATERIAL Silicon Rubber |
| WEIGHT 9.12 g |

NOTES:
1. DIMENSIONS SHOWN ARE CRITICAL TO FUNCTION. ALL OTHERS PER ELECTRONIC MODEL.
2. COLOR: PANTONE PLASTICS #2024-1, OR APPROVED EQUIVALENT COLOR MATCH
3. TYPICAL DRAFT: 1° UNLESS NOTED
4. TYPICAL RADIUS: 0.5MM UNLESS NOTED
5. TEXTURE: SPI D-2 LIGHT EDM
6. SURFACE REQUIREMENTS:
   - PART TO BE FREE OF SINKS, VOIDS, AND POROSITY
   - PART TO BE FREE OF OIL, DIRT, OR OTHER SURFACE CONTAMINATION
   - EJECTOR PINS FLUSH TO RECESSED 0.01 OF ANY SURFACE
   - FLASH TO BE FLUSH TO 0.13 FROM ANY SURFACE
   - PARTING LINE MISMATCH: 0.13 MAX
   - GATE, EJECTOR PINS, AND PARTING LINE LOCATIONS REQUIRE ENGINEERING APPROVAL
7. MATERIAL DUROMETER: SHORE A30 +/-5

FIG. 23

| TOLERANCES UNLESS NOTED | |
|---|---|
| mm | [INCHES] |
| .XX = ±.10 | .XXX = ± 005 |
| .X = ±.25 | .XX = ±.010 |
| ANGLES = ±1° | |
| MATERIAL | |
| ABS | |
| WEIGHT | |
| 2.662 g | |

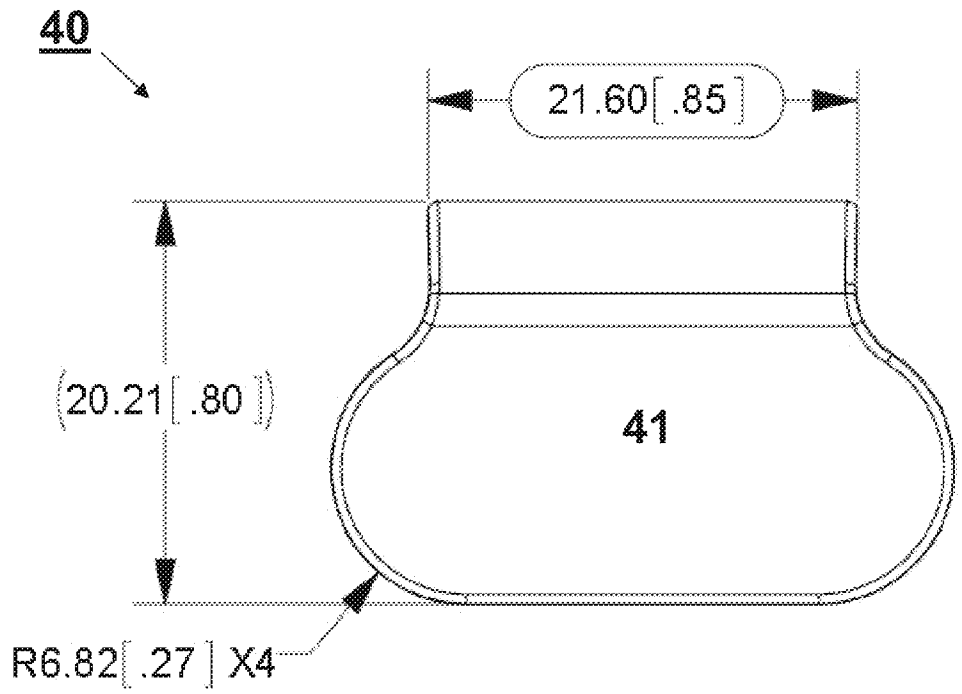

NOTES:
1. DIMENSIONS SHOWN ARE CRITICAL TO FUNCTION. ALL OTHERS PER ELECTRONIC MODEL
2. COLOR: PER ORDER, SEE CHART
3. TYPICAL DRAFT: 1° UNLESS NOTED
4. TYPICAL RADIUS: 0.5MM UNLESS NOTED
5. TEXTURE: SPI D-3 LIGHT EDM
6. SURFACE REQUIREMENTS
   - PART TO BE FREE OF SINKS, VOIDS, AND POROSITY
   - PART TO BE FREE OF OIL, DIRT, OR OTHER SURFACE CONTAMINATION
   - EJECTOR PINS: FLUSH TO RECESSED 0.13 OF ANY SURFACE
   - FLASH TO BE FLUSH TO 0.13 FROM ANY SURFACE
   - PARTING LINE MISMATCH: 0.13 MAX
   - GATE, EJECTOR PINS, AND PARTING LINE LOCATIONS REQUIRE ENGINEERING APPROVAL

FIG. 25

| TOLERANCES UNLESS NOTED | |
|---|---|
| mm | [INCHES] |
| .XX = ±.10 | .XXX = ±.005 |
| .X = ±.25 | .XX = ±.010 |
| ANGLES = ±1° | |
| MATERIAL | |
| ABS | |
| WEIGHT | |
| 2.662 g | |

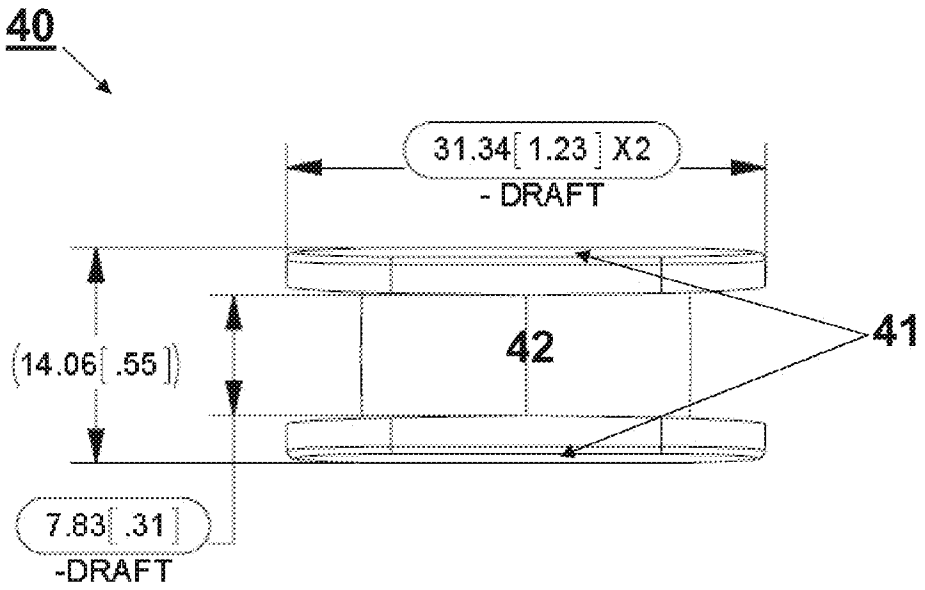

NOTES:
1. DIMENSIONS SHOWN ARE CRITICAL TO FUNCTION. ALL OTHERS PER ELECTRONIC MODEL
2. COLOR: PER ORDER, SEE CHART
3. TYPICAL DRAFT: 1° UNLESS NOTED
4. TYPICAL RADIUS: 0.5MM UNLESS NOTED
5. TEXTURE: SPI D-3 LIGHT EDM
6. SURFACE REQUIREMENTS
   - PART TO BE FREE OF SINKS, VOIDS, AND POROSITY
   - PART TO BE FREE OF OIL, DIRT, OR OTHER SURFACE CONTAMINATION
   - EJECTOR PINS: FLUSH TO RECESSED 0.13 OF ANY SURFACE
   - FLASH TO BE FLUSH TO 0.13 FROM ANY SURFACE
   - PARTING LINE MISMATCH: 0.13 MAX
   - GATE, EJECTOR PINS, AND PARTING LINE LOCATIONS REQUIRE ENGINEERING APPROVAL

FIG. 26

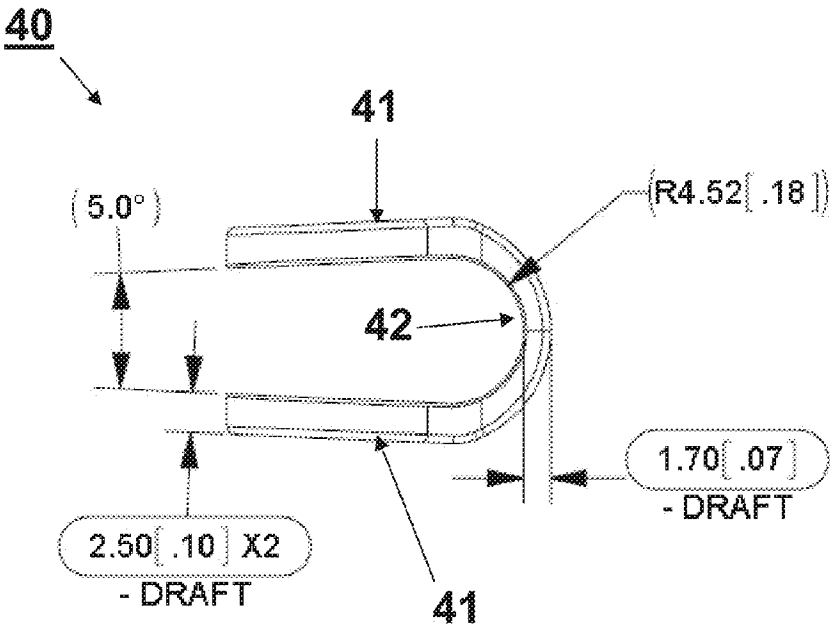

| TOLERANCES UNLESS NOTED | |
|---|---|
| mm | [INCHES] |
| XX = ±.10 | XXX = ±.005 |
| X = ±.25 | XX = ±.010 |
| ANGLES = ±1° | |
| MATERIAL | |
| ABS | |
| WEIGHT | |
| 2.662 g | |

NOTES:

1. DIMENSIONS SHOWN ARE CRITICAL TO FUNCTION. ALL OTHERS PER ELECTRONIC MODEL
2. COLOR PER ORDER, SEE CHART
3. TYPICAL DRAFT 1° UNLESS NOTED
4. TYPICAL RADIUS 0.5MM UNLESS NOTED
5. TEXTURE SPI D-3 LIGHT EDM
6. SURFACE REQUIREMENTS
   - PART TO BE FREE OF SINKS, VOIDS, AND POROSITY
   - PART TO BE FREE OF OIL, DIRT, OR OTHER SURFACE CONTAMINATION
   - EJECTOR PINS FLUSH TO RECESSED 0.13 OF ANY SURFACE
   - FLASH TO BE FLUSH TO 0.13 FROM ANY SURFACE
   - PARTING LINE MISMATCH 0.13 MAX
   - GATE, EJECTOR PINS, AND PARTING LINE LOCATIONS REQUIRE ENGINEERING APPROVAL

FIG. 27

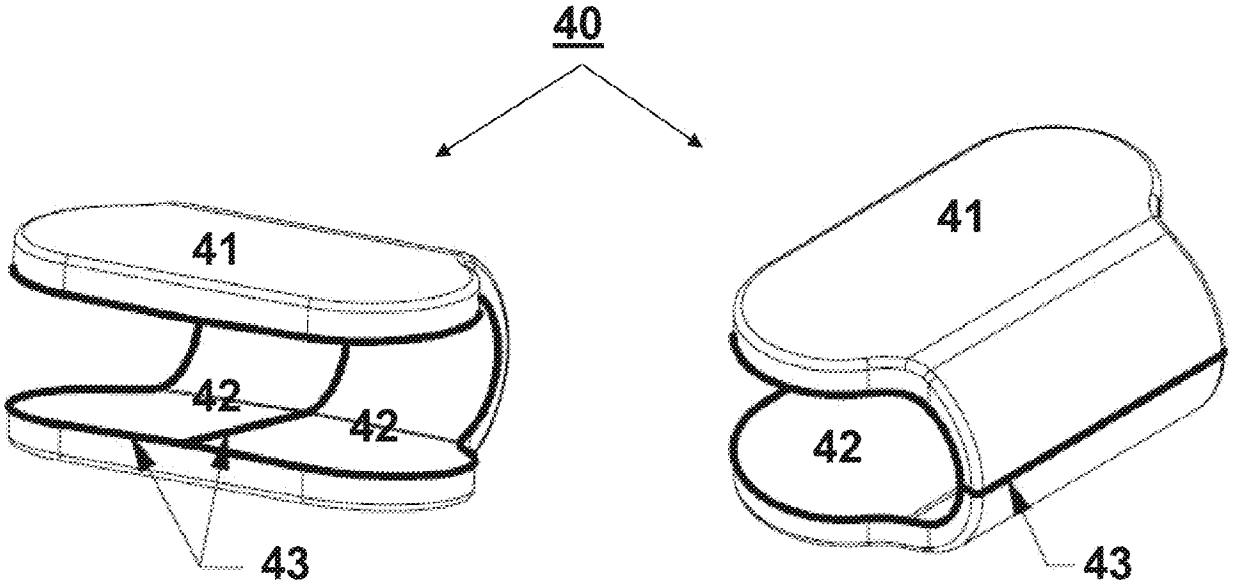

| TOLERANCES UNLESS NOTED | |
|---|---|
| mm | [INCHES] |
| XX = ±.10 | XXX = ±.005 |
| X = ±.25 | XX = ±.010 |
| ANGLES = ±1° | |
| MATERIAL | |
| ABS | |
| WEIGHT | |
| 2.662 g | |

NOTES:
1. DIMENSIONS SHOWN ARE CRITICAL TO FUNCTION. ALL OTHERS PER ELECTRONIC MODEL
2. COLOR: PER ORDER, SEE CHART
3. TYPICAL DRAFT: 1° UNLESS NOTED
4. TYPICAL RADIUS: 0.5MM UNLESS NOTED
5. TEXTURE: SPI D-3 LIGHT EDM
6. SURFACE REQUIREMENTS
   - PART TO BE FREE OF SINKS, VOIDS, AND POROSITY
   - PART TO BE FREE OF OIL, DIRT, OR OTHER SURFACE CONTAMINATION
   - EJECTOR PINS: FLUSH TO RECESSED 0.13 OF ANY SURFACE
   - FLASH TO BE FLUSH TO 0.13 FROM ANY SURFACE
   - PARTING LINE MISMATCH: 0.13 MAX
   - GATE, EJECTOR PINS, AND PARTING LINE LOCATIONS REQUIRE ENGINEERING APPROVAL

FIG. 28

| TOLERANCES UNLESS NOTED [INCHES] mm | |
|---|---|
| .XX = ± .10 | .XXX = ± .005 |
| .X = ± .25 | .XX = ± .010 |
| ANGLES = ±1° | |
| MATERIAL N/A | |
| WEIGHT N/A g | |

NOTES:
1. ASSEMBLY TO BE PACKAGED WITH (10) UNITS PER PACK, TWO IN EACH COLOR
2. PACKAGING REQUIRES DESIGN APPROVAL
3. RUBBER CLAMSHELL TO BE FOLDED AND HELD CLOSED BY PLASTIC CLIP

DEVICE AND SYSTEM FOR DIFFERENTIATING SPECIFIC LEAD WIRES IN A MULTI-WIRE ENVIRONMENT

CROSS-REFERENCE TO RELATED APPLICATIONS

This application claims the benefit of U.S. Provisional Application 61/794,048, which was filed on Mar. 15, 2013.

BACKGROUND OF THE INVENTION

The present invention relates to a system of identifying and differentiating between wires in a multi-wire environment, and more specifically, to lead wire identifiers or markers on electrical stimulation machines, generally referred to as "E-Stim machines" in physical therapy.

Standard E-Stim machines have long lead wires that reach from the patient to the machine. These wires look similar and are often tangled, making it difficult to differentiate which wire is plugged into which port on the machine, and/or which lead wire is going to which patient. The wires are often stretched several feet away from the machine, further causing technician confusion. This confusion sometimes causes incorrect placement of wires, resulting in the wrong stimulation being performed on the wrong patient, or wrong part of the patient's body.

As can be seen, there is a need for an efficient system of quickly and easily identifying and differentiating between the wires in a multi-wire environment.

It is desirable that this system includes color coded cord identification clamps (or "clamshells") and clips, preferably in sets. It is desirable that the system can accommodate a variety of standard shapes and thicknesses of wires without sliding, and are shaped to prevent unwanted wire snagging.

SUMMARY OF THE INVENTION

Broadly, an embodiment of the invention provides an identification system including a clamshell device that grasps a wire, and a clip that secures the clamshell device in a locked and closed position. An embodiment of the invention preferably includes a color-coded clamshell and/or clip to differentiate one wire from another, hereby allowing a technician to easily discern which wire is plugged into which port, and which wire is connected to which patient. The invention is particularly well suited for incorporation with healthcare devices and machines which have long lead wires that reach from the patient to the machine, such as electrical stimulation machines. The system is configured to be reusable, versus a one-use device with, for example, an irreversible securing means. Also, the system can be used with a variety of standard sized and shaped wires without permitting unwanted slippage. Also, a moisture-proof seal is formed between the device and the wire segment, thereby providing a sanitary device for use in clinical settings.

BRIEF DESCRIPTION OF THE DRAWINGS

FIG. 22 depicts a side schematic view of one half of the clamshell;

FIG. 23 depicts a top interior and bottom exterior perspective view of the clamshell in the open position, showing the textured and non-textured surfaces;

FIG. 25 is a schematic top view of the clip of FIG. 14;

FIG. 26 is a schematic front view of the clip of FIG. 14;

FIG. 27 is a schematic side view of the clip of FIG. 14

FIG. 28 is the same front and rear perspective views of the clip of FIG. 17, depicting the parting line;

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

As used herein, the follow structure numbers are associated with the stated structures among the various figures:

10—Identification system;

12—Semi-conformable material;

14—Rounded ends;

16—Hinge;
17—First side;
18—Second side;
20—Clamshell;
21—Alignment protrusion;
22—Alignment receiver;
24—Clamshell parting line;
25—Textured clamshell recessed exterior;
26—Non-textured clamshell interior;
27—Clip receiving notch;
30—Cord channel;
40—Clip;
41—Textured clip exterior;
42—Non-textured clip interior;
43—Clip parting line; and
50—Cord.

Broadly, an embodiment of the invention provides an identification system including a clamshell device that grasps a wire, and a clip that secures the clamshell device in a locked and closed position.

Figure 1:
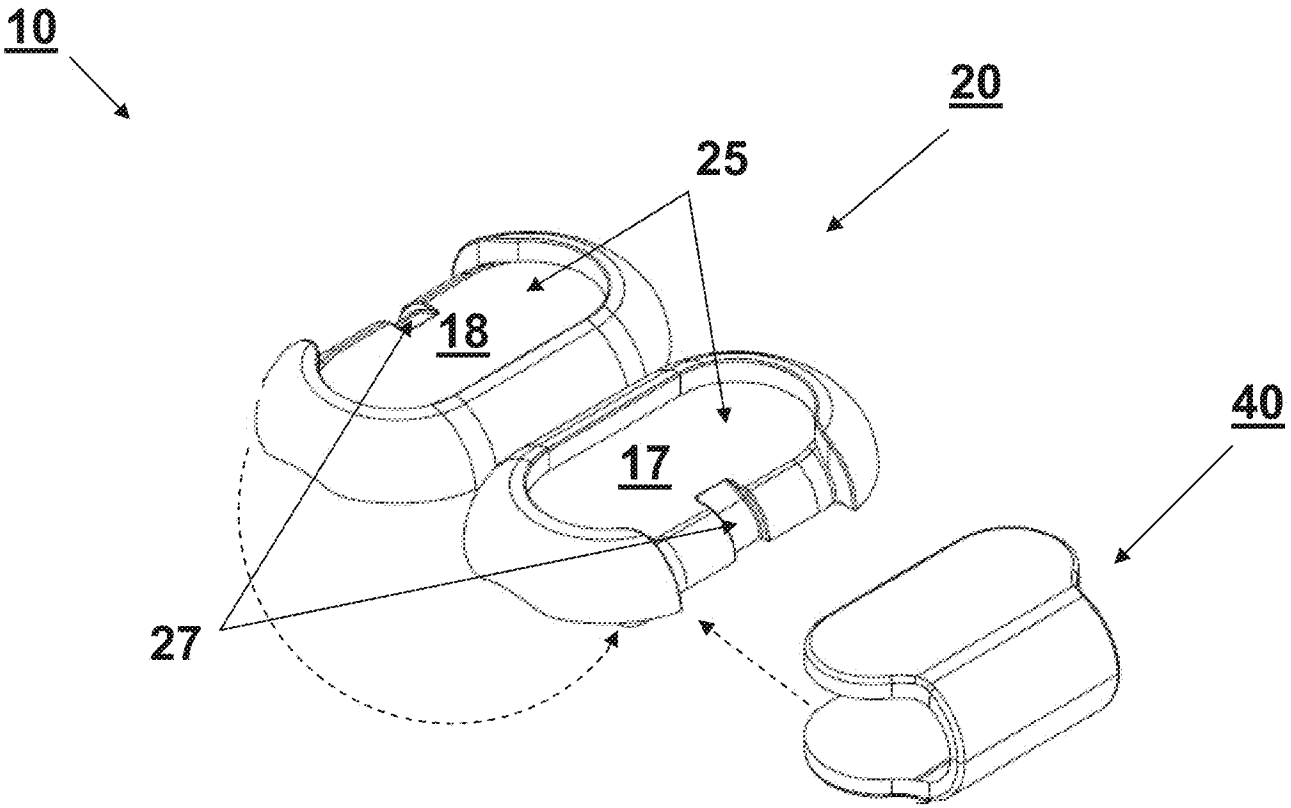
FIG. 1 depicts a hinged clamshell in an open position with the clip detached.
Figure 2:
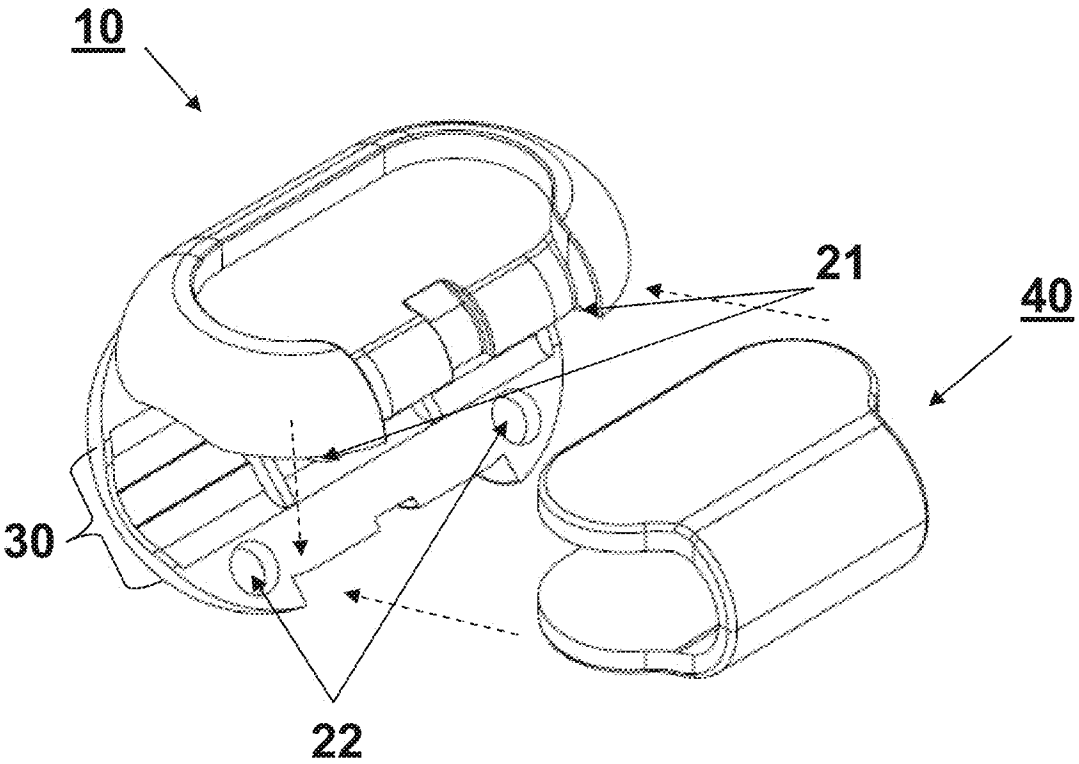
FIG. 2 depicts a hinged clamshell in a semi-closed position with the clip detached.
Figure 3:
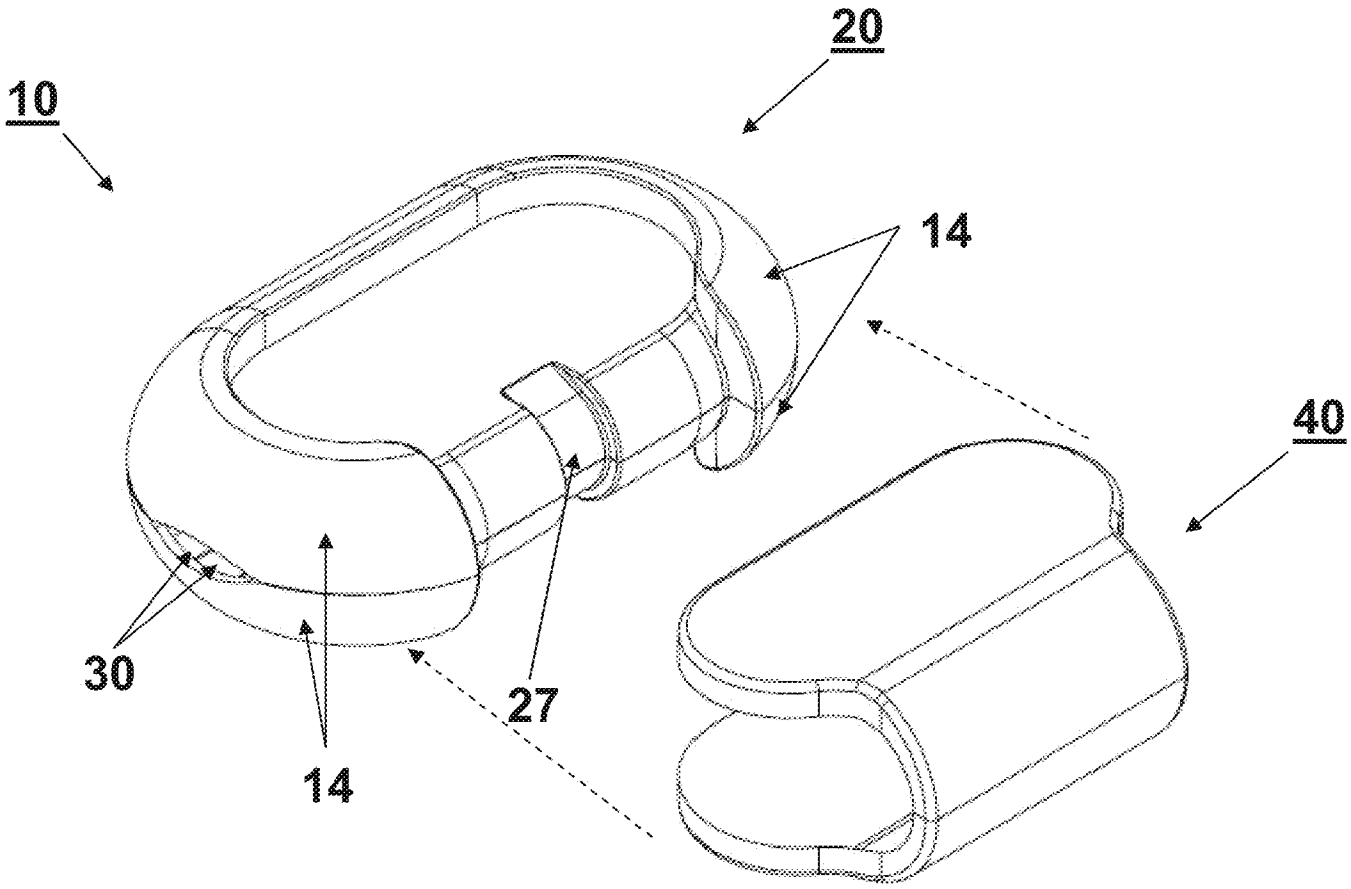
FIG. 3 depicts a hinged clamshell in a closed position with the clip detached.
Figure 4:
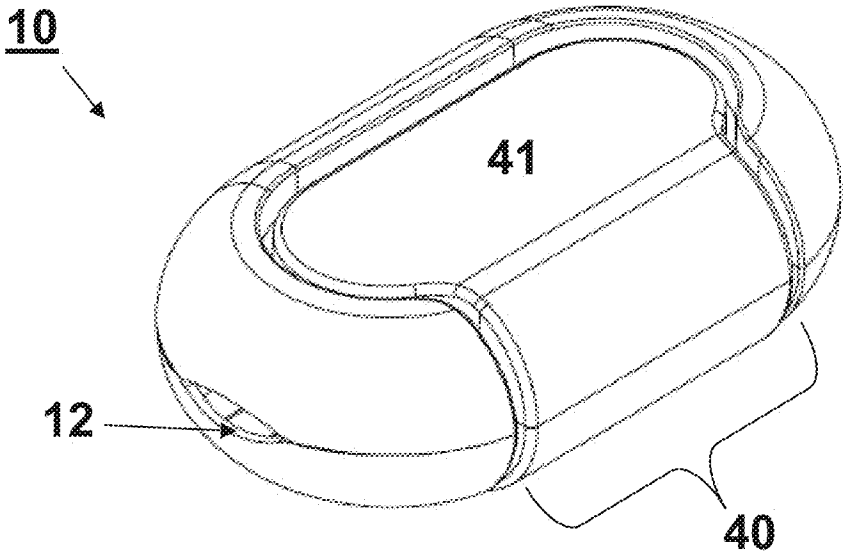
FIG. 4 depicts a hinged clamshell in a closed position with the clip attached.

Referring to FIG. 1, identification system 10 generally includes clamshell 20 and clip 40. Clamshell 20 includes first side 17 and second side 18, which are substantially similar and joined at hinge 16 (best shown in FIG. 10). In use first side 17 and second side 18 are pivoted relative to each other along hinge, as shown in FIG. 2. FIG. 3 depicts clamshell 20 in the closed position, with clip 40 oriented to slip onto closed clamshell and secure it in the closed position. Clip receiving notch 27 helps to align and secure clip 40 on closed clamshell 20. FIG. 4 depicts identification system 10 in the closed and secured position.

Figure 10:
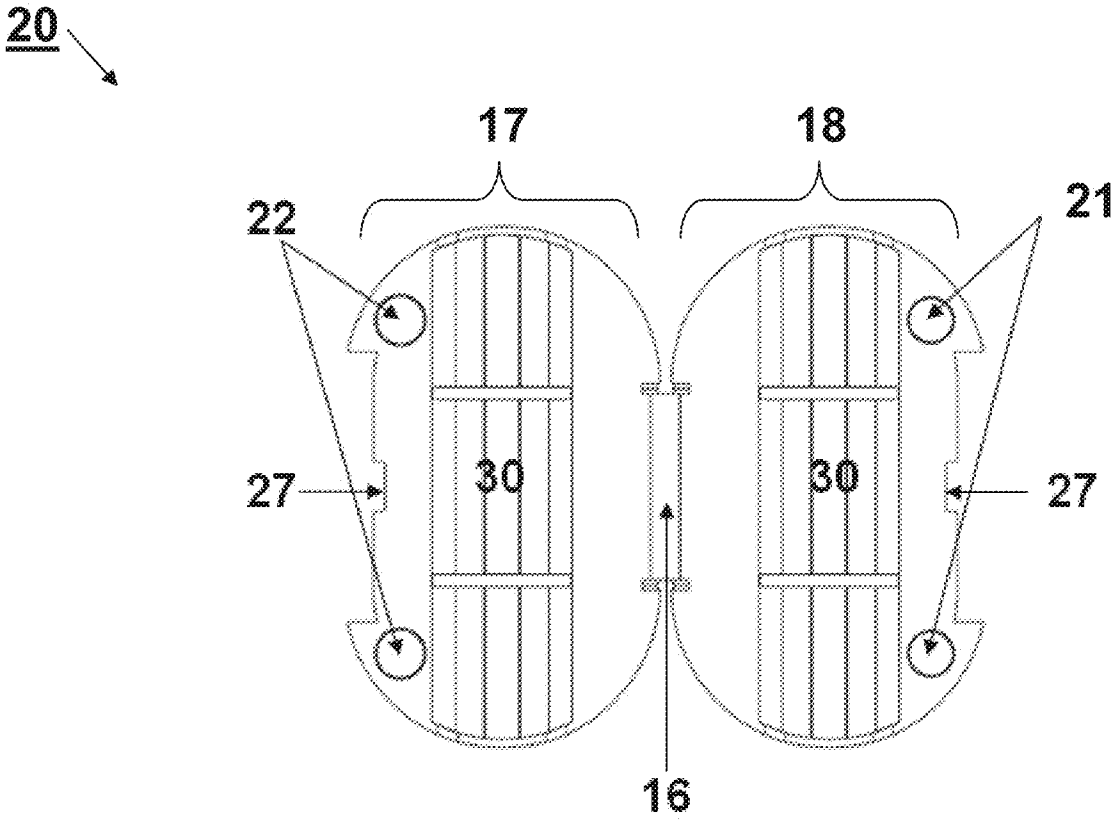
FIG. 10 depicts a top perspective view of the interior of the open clamshell of FIG. 1.
Figure 11:
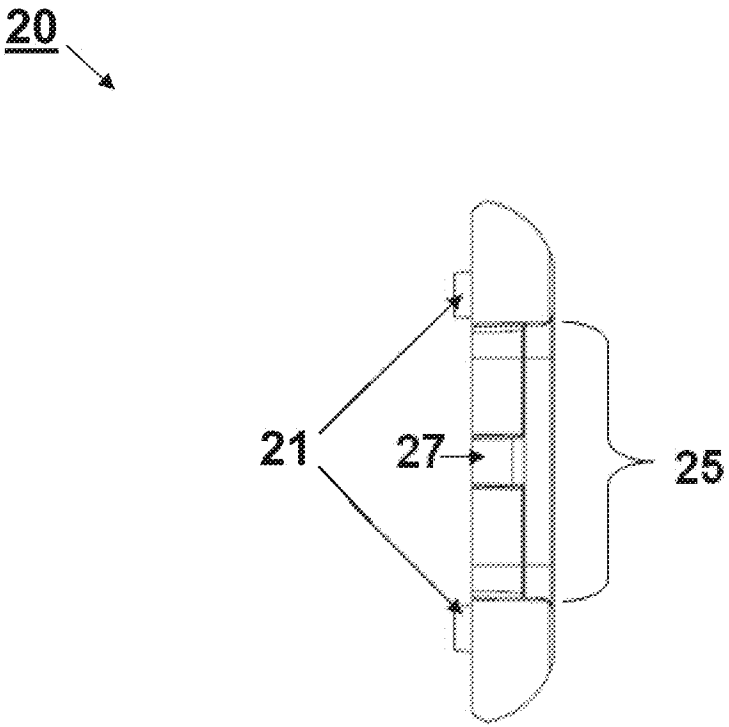
FIG. 11 depicts a side perspective view of the open clamshell of FIG. 1.

As shown in FIG. 10, the interior of clamshell 20 preferably includes a pair of alignment protrusions 21 (shown best in FIG. 11) and corresponding alignment receivers 22. These structures preferably don't "snap" into place, irreversibly or otherwise, but rather ensure the first and second sides align properly and prevent lateral displacement of one side relative to the other.

Figure 5:
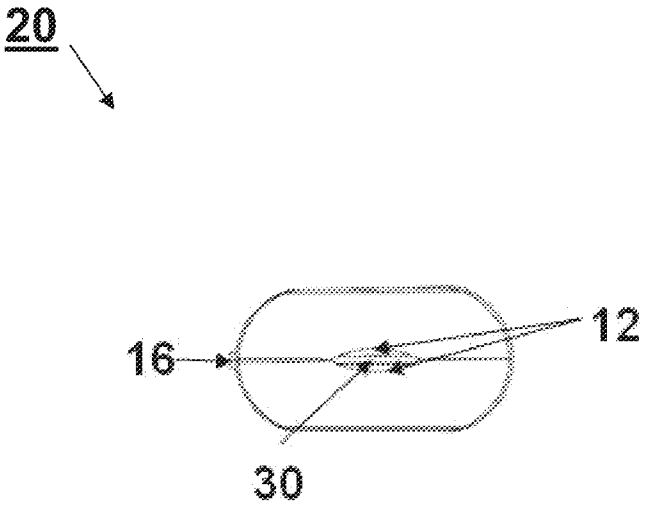
FIG. 5 depicts an end perspective view of the closed clamshell with clip attached of FIG. 4.
Figure 6:
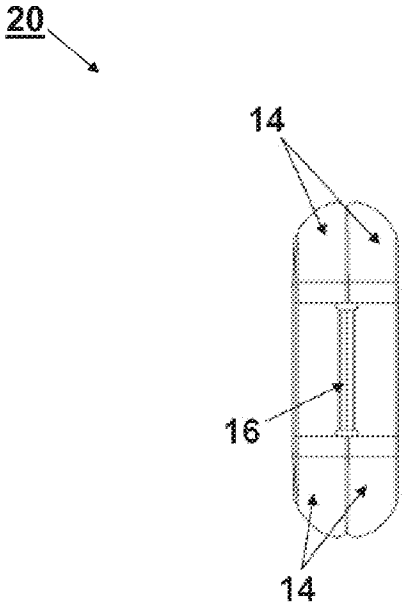
FIG. 6 depicts left-side perspective view of the closed clamshell with clip attached of FIG. 4.
Figure 32:
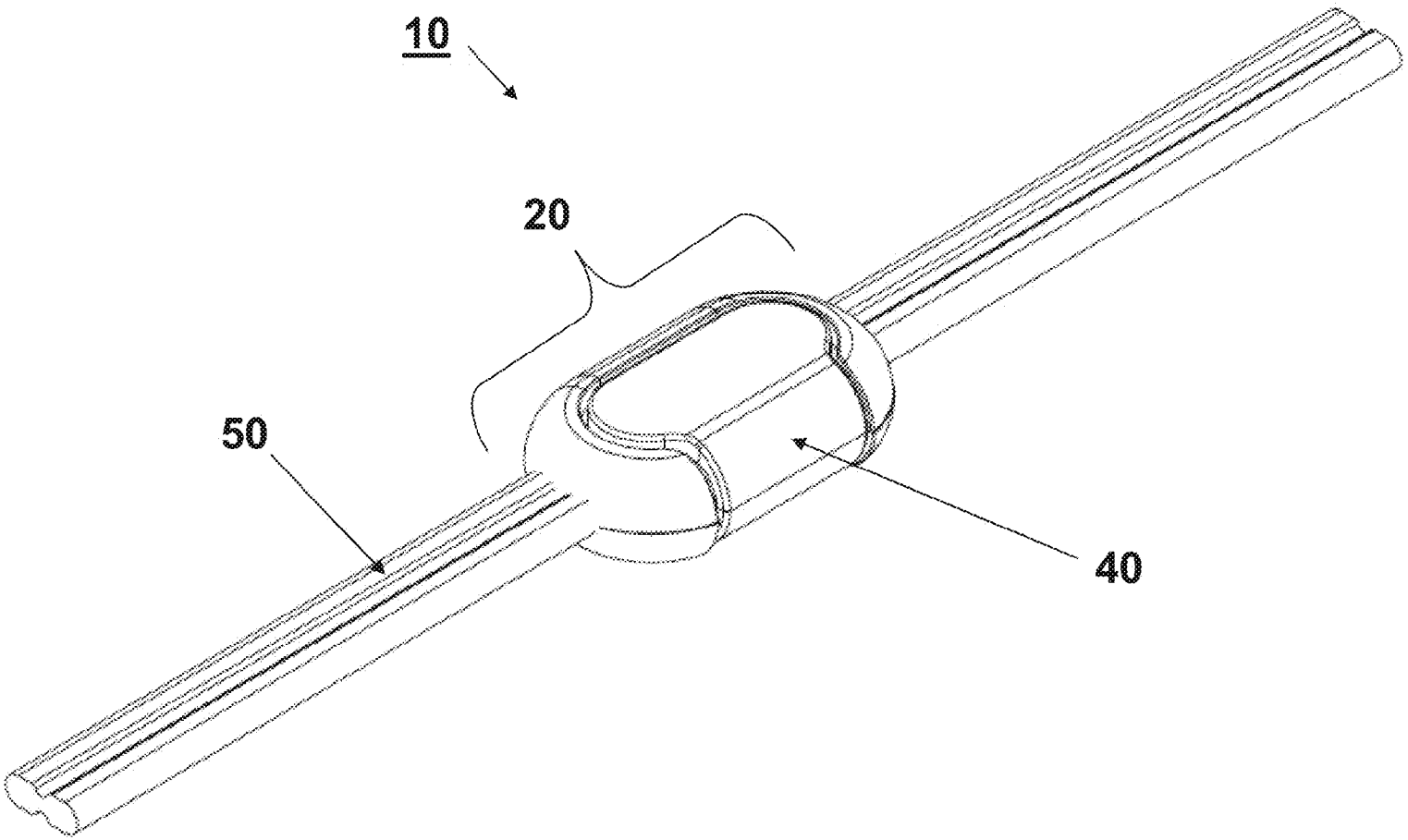
FIG. 32 is a perspective view of the clamshell in the closed position with cords and clip in place.

In regular use system 10 would be positioned on cord 50, as shown in FIG. 32. More specifically, cord extends through cord channel 30, as shown in FIGS. 5, and 19-21. As shown in FIG. 5, cord channel 30 includes semi-conformable material 12, which serves several functions including preventing moisture and other contaminants from entering into channel 30, as well as providing a snug fit between clamshell and cord, thereby preventing the cord from slipping back and forth within the clamshell. Conformable material 12 may be uniform, irregular, or discontinuous such as ribs.

Figure 7:
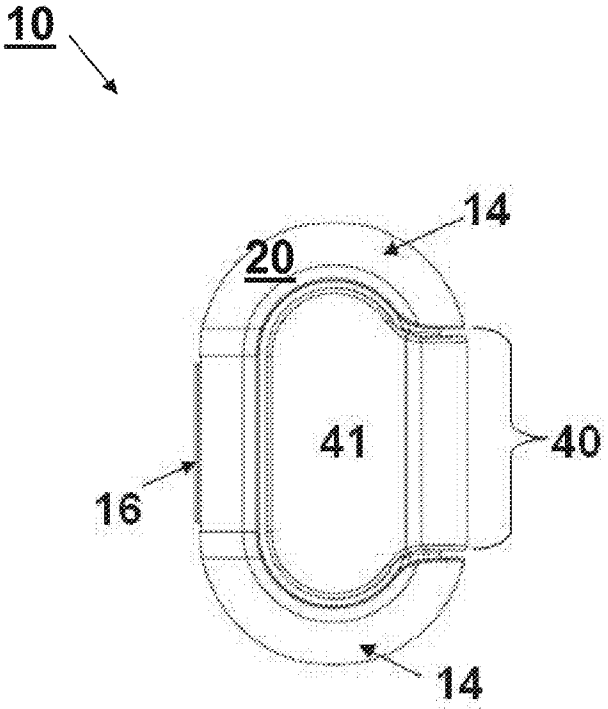
FIG. 7 depicts a top perspective view of the closed clamshell with clip attached of FIG. 4.
Figure 8:
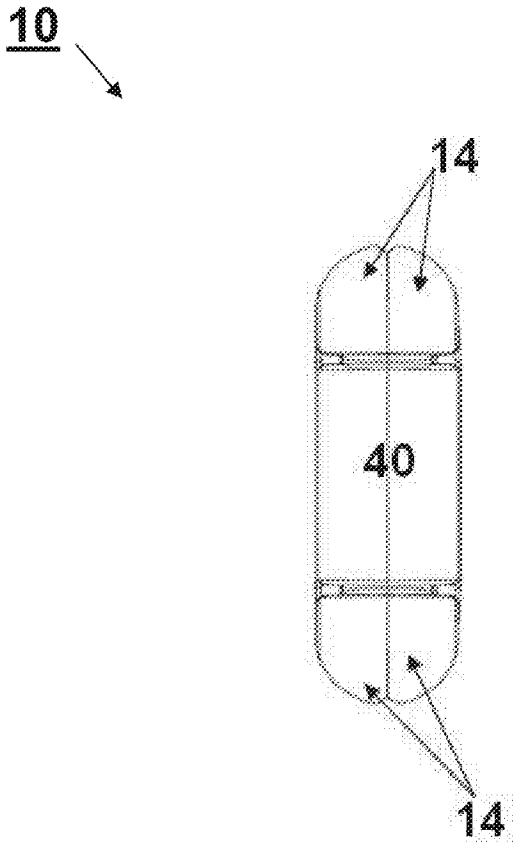
FIG. 8 depicts a right-side perspective view of the closed clamshell with clip attached of FIG. 4.
Figure 9:
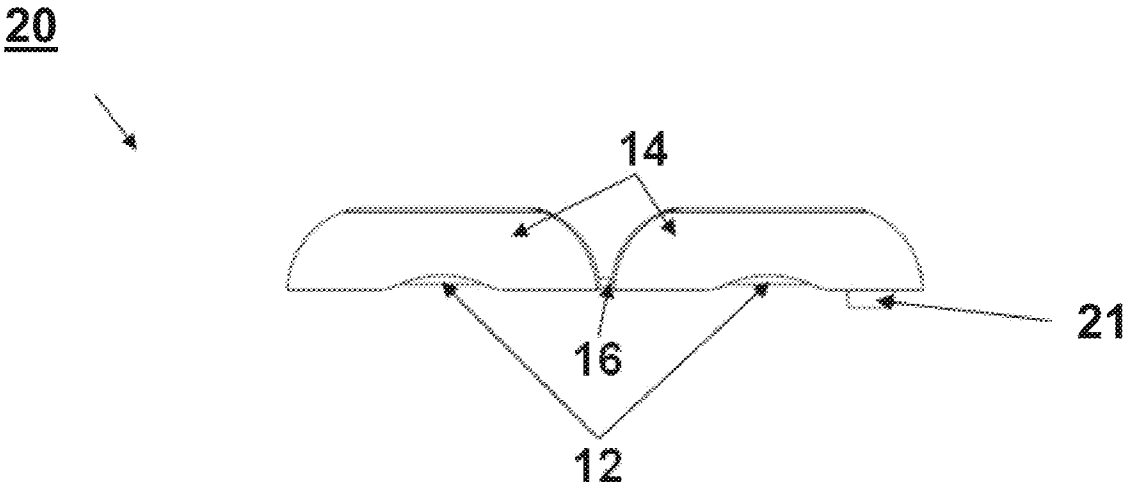
FIG. 9 depicts an end perspective view of the open clamshell of FIG. 1.
Figure 12:
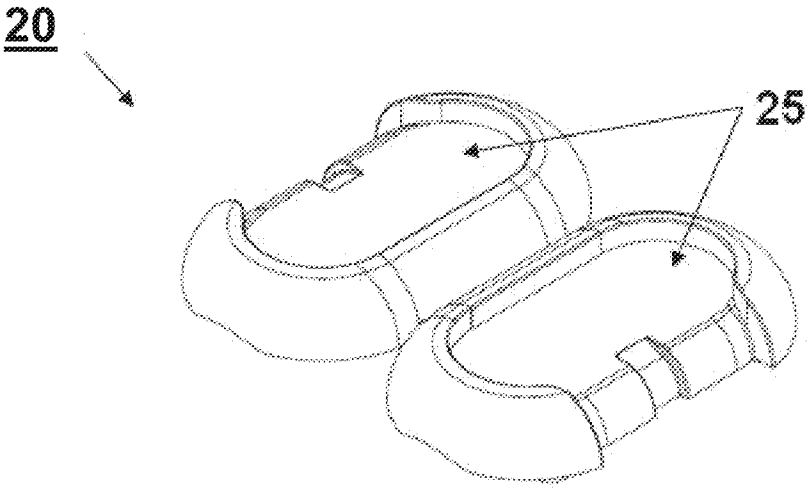
FIG. 12 depicts a perspective view of the exterior of the open clamshell of FIG. 1.
Figure 13:
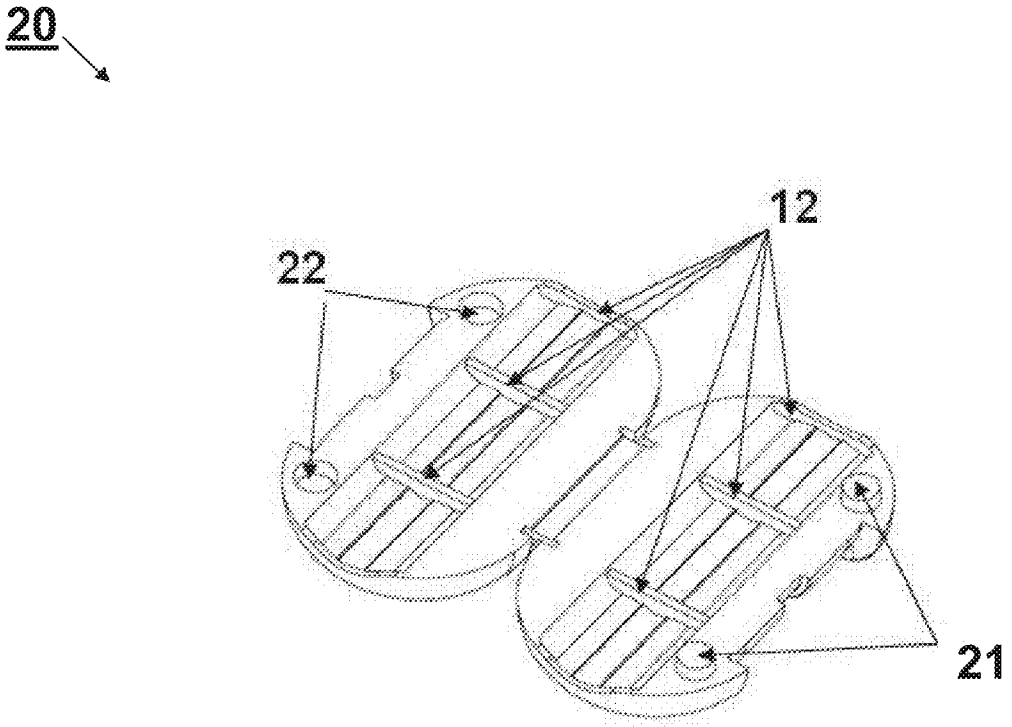
FIG. 13 depicts a perspective view of the interior of the open clamshell of FIG. 1.
Figure 14:
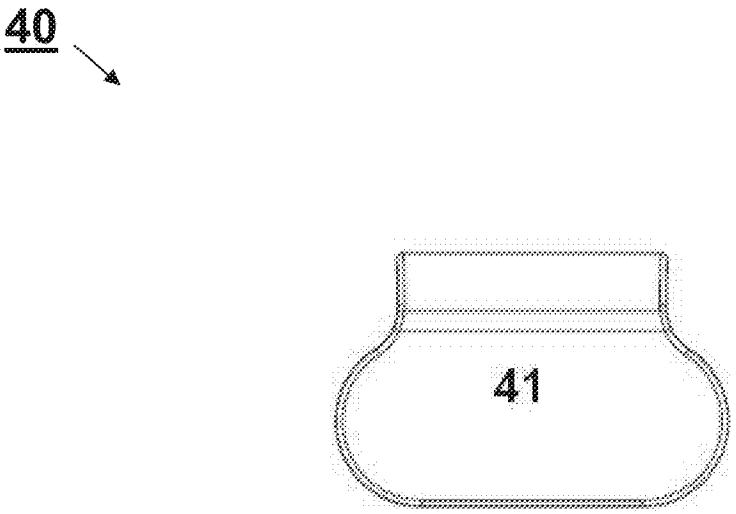
FIG. 14 depicts a top perspective view of the detached clip.
Figure 15:
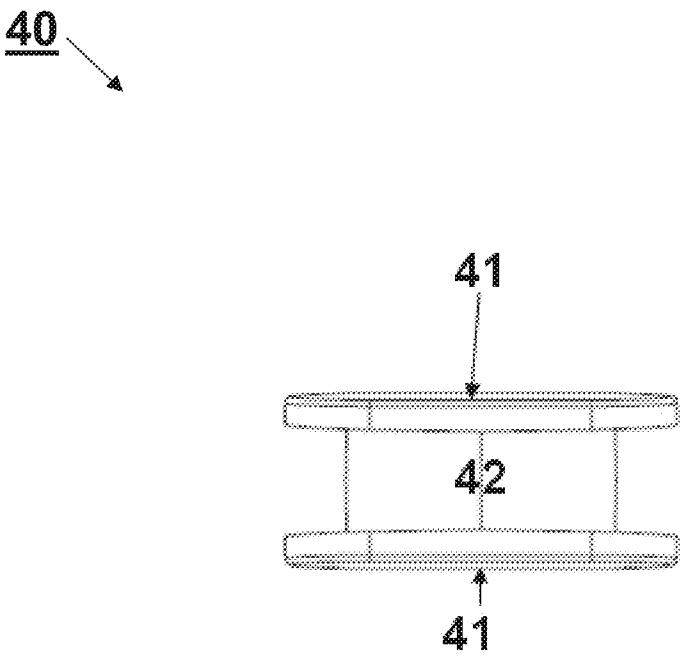
FIG. 15 depicts a front perspective view of the detached clip.
Figure 16:
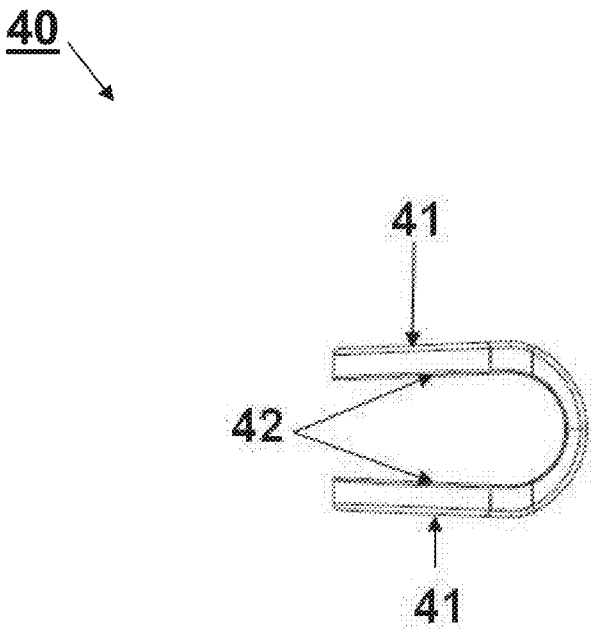
FIG. 16 depicts a side perspective view of the detached clip.
Figure 17:
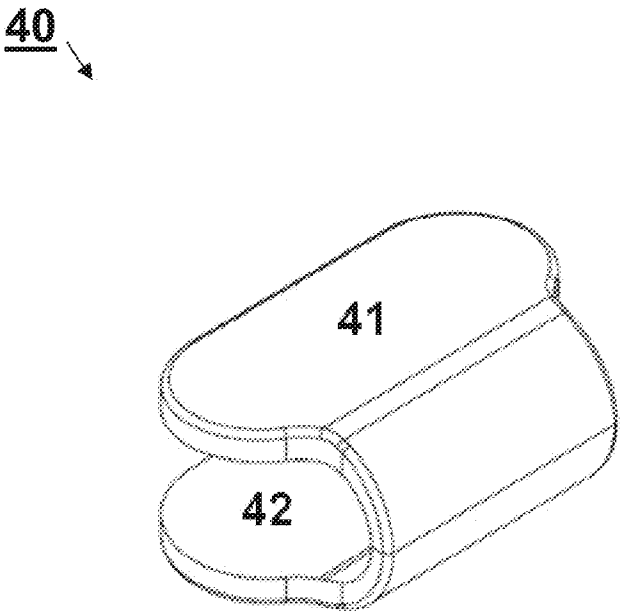
FIG. 17 depicts a top rear perspective view of the detached clip of FIG. 14.
Figure 18:
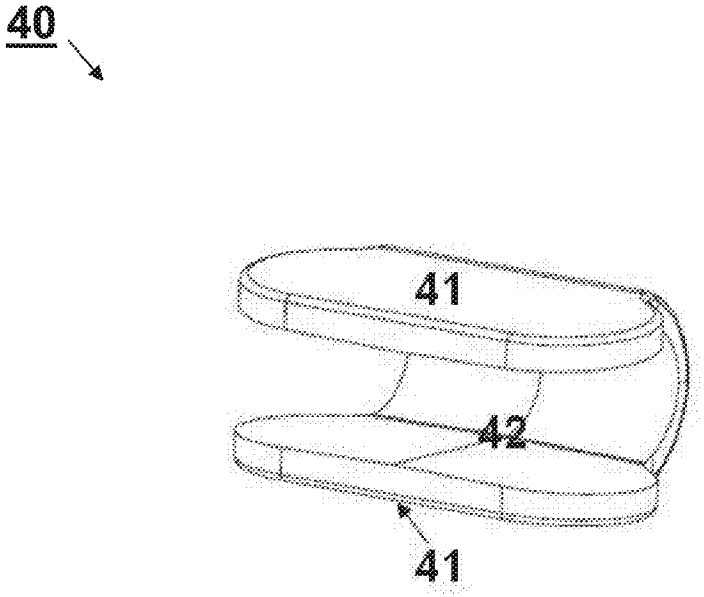
FIG. 18 depicts a top front perspective view of the detached clip of FIG. 14.
Figure 19:
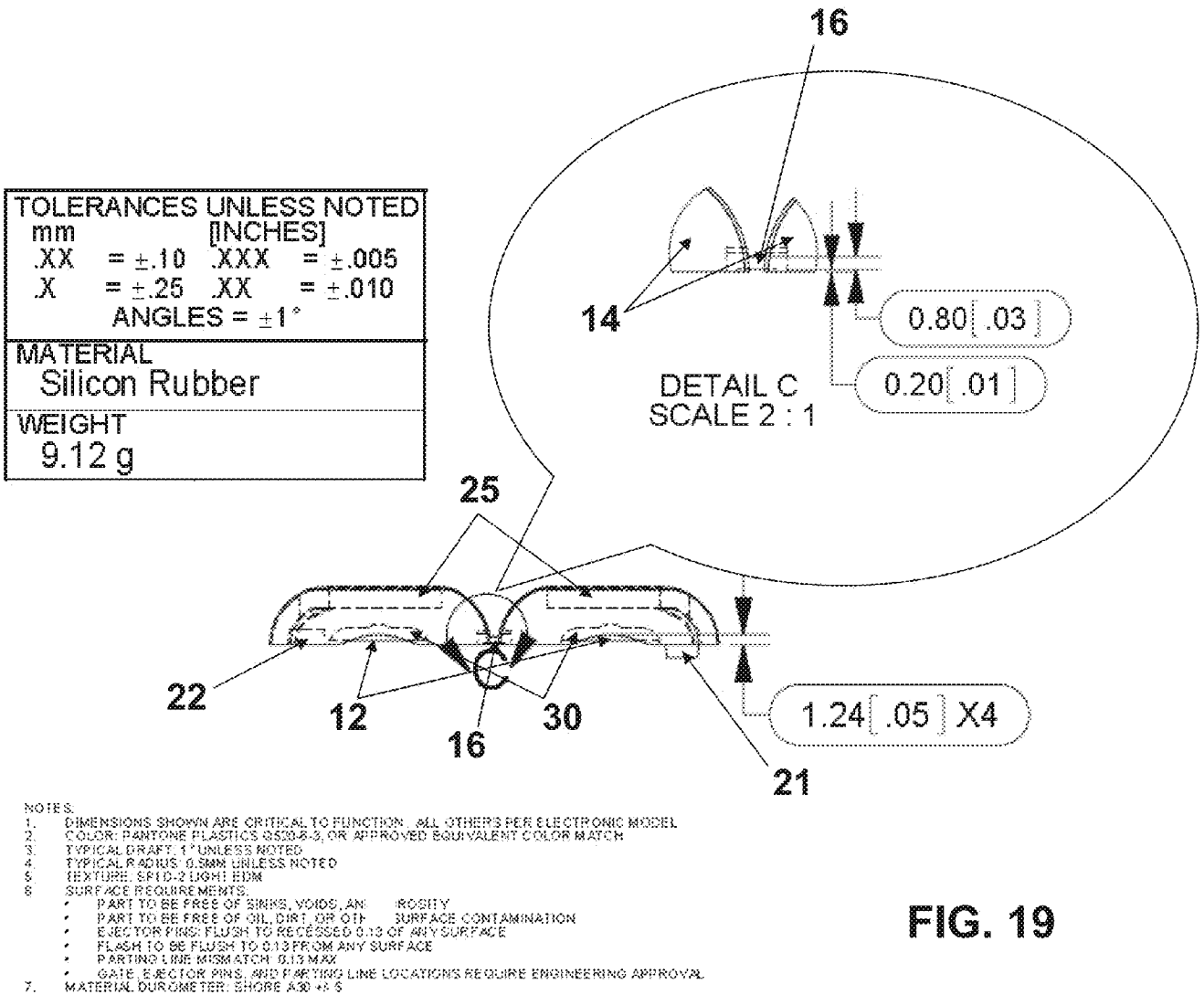
FIG. 19 depicts a perspective schematic view of the exterior of the clamshell in the open position with an exploded view of the hinge.
Figure 20:
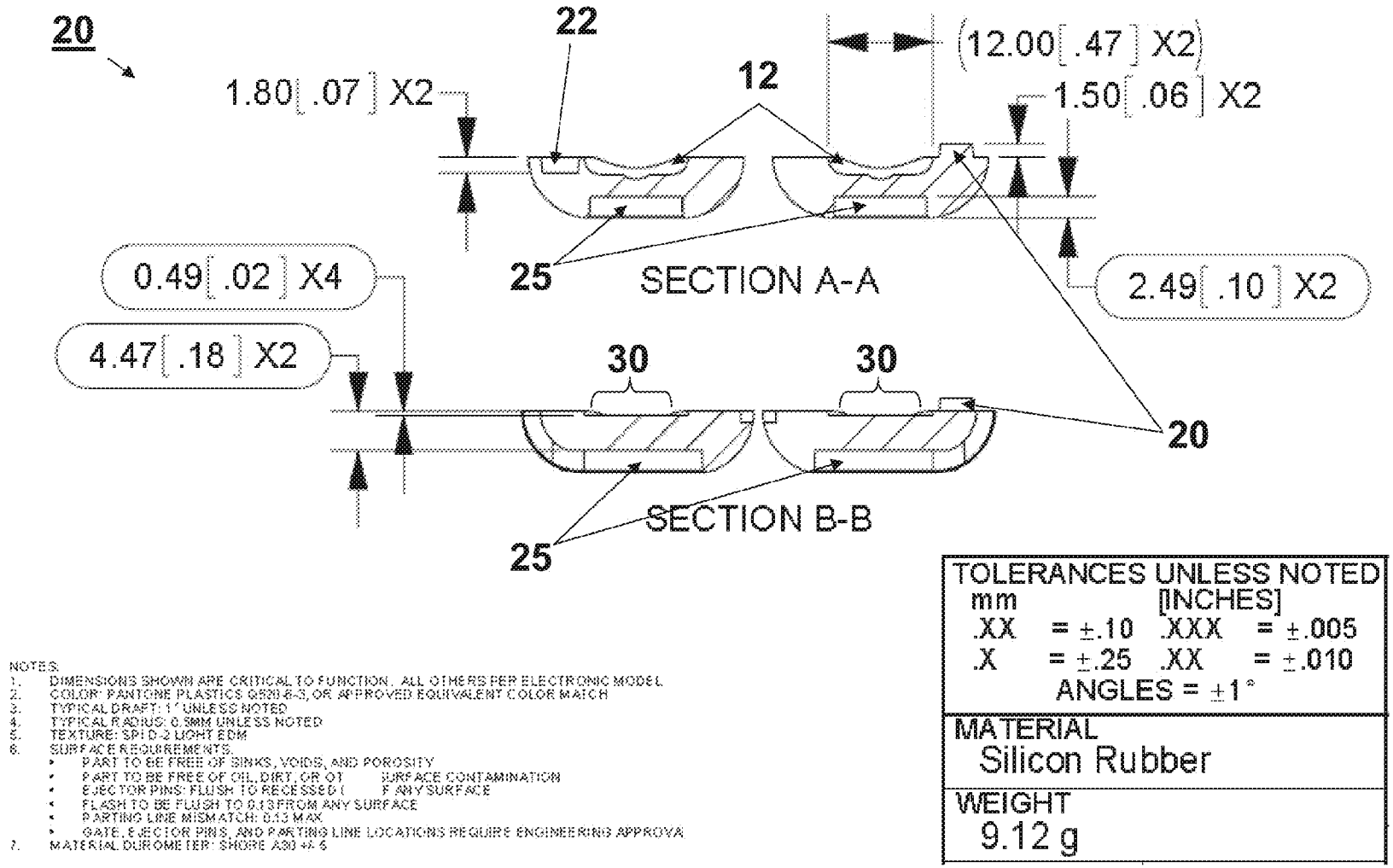
FIG. 20 depicts a perspective schematic view of each end of the clamshell with the hinge unattached.
Figure 21:
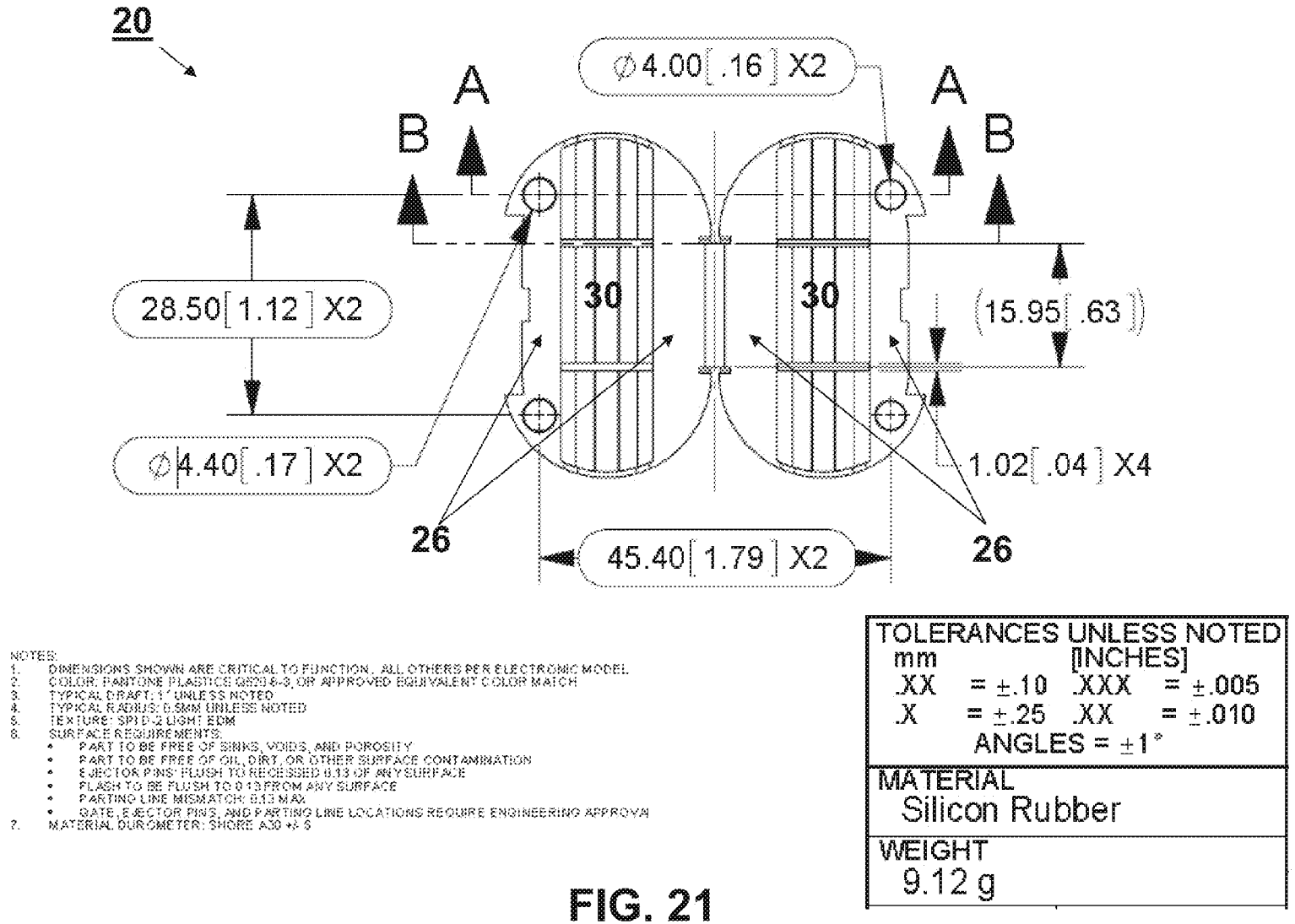
FIG. 21 depicts a top schematic view of the interior of the clamshell in the open position.
Figure 24:
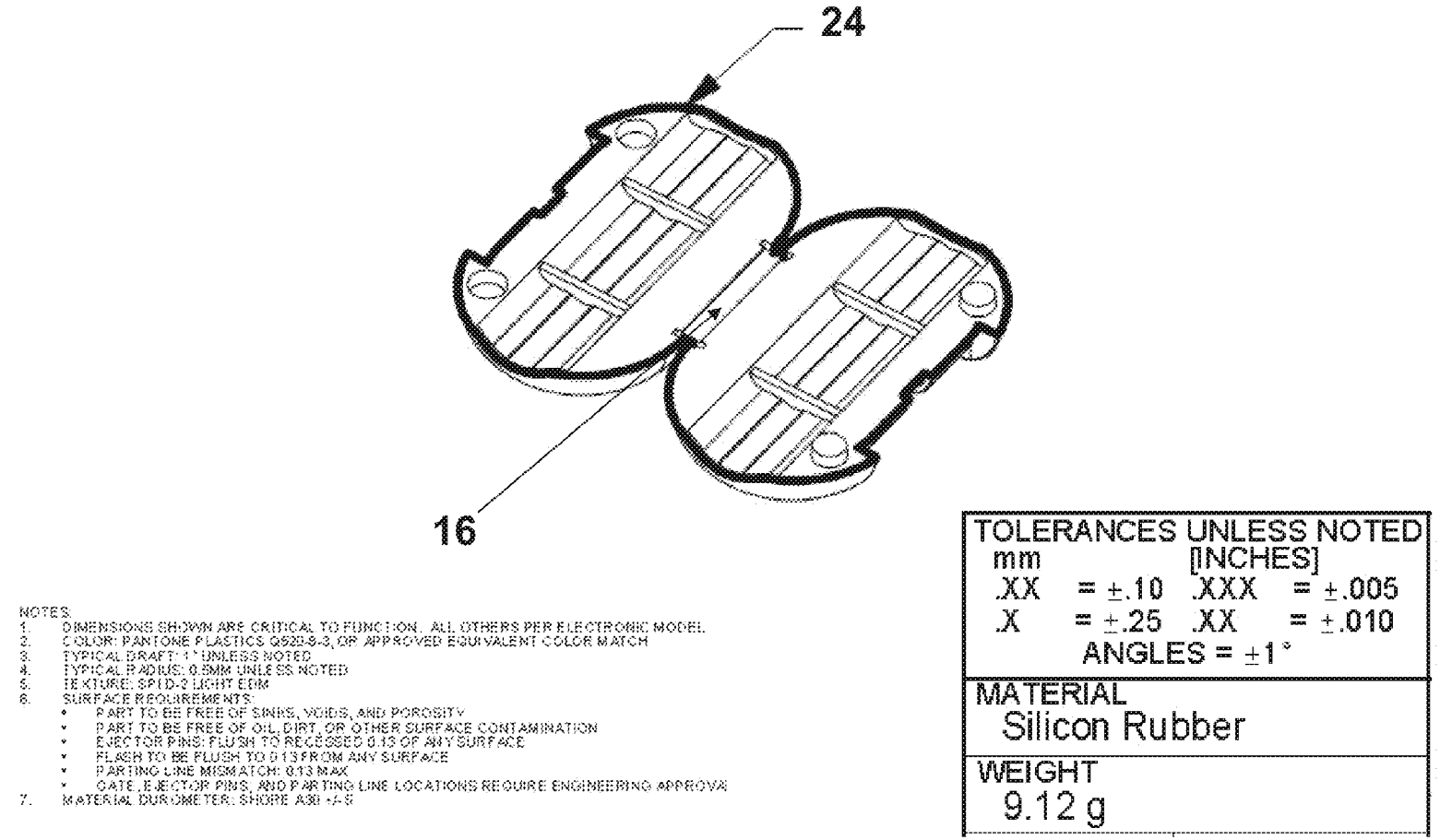
FIG. 24 is a perspective view of the interior of the clamshell in the open position, depicting the parting line.
Figure 29:
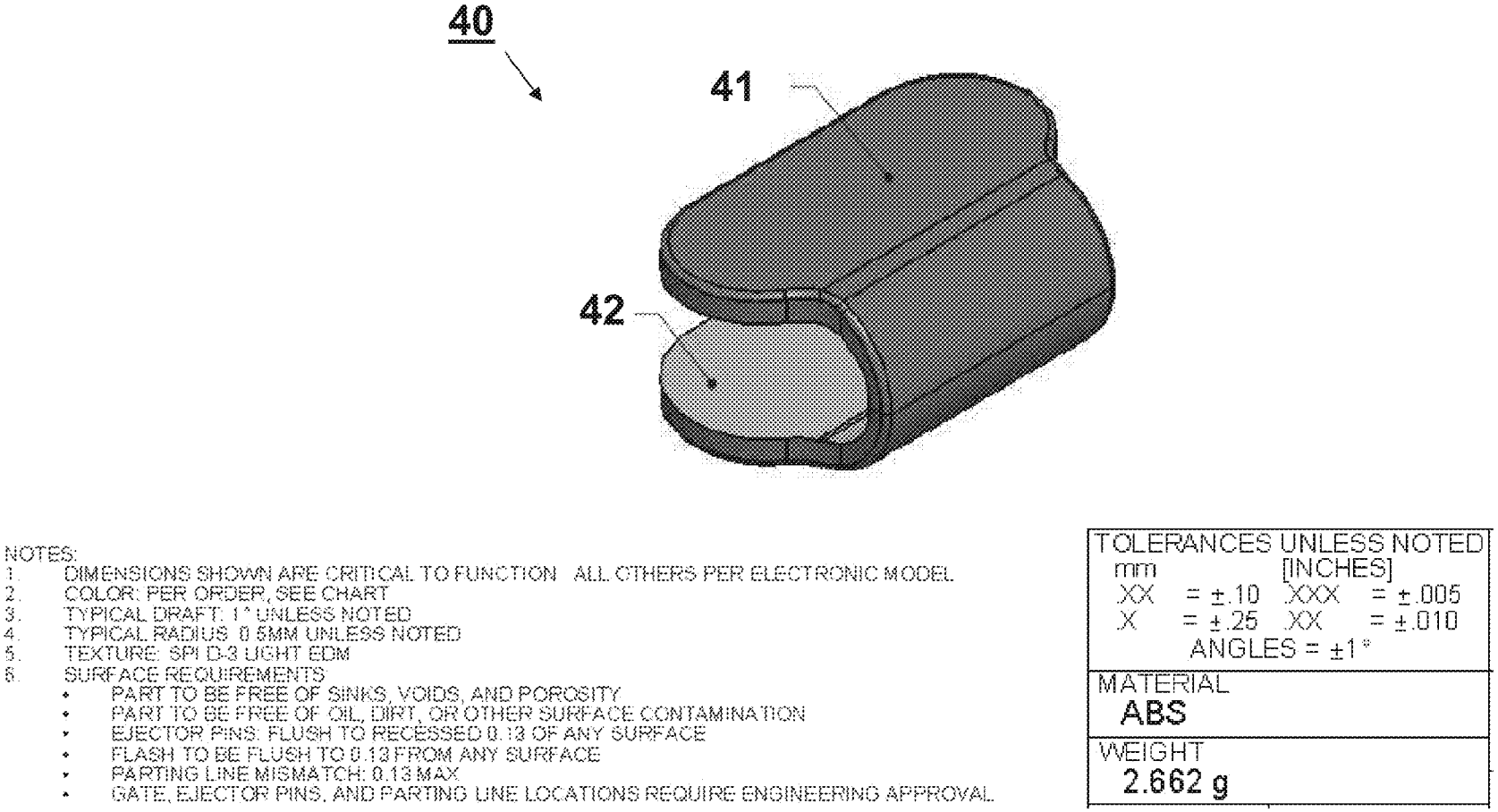
FIG. 29 is a perspective view of the clip of FIG. 17, depicting the textured and non-textured surfaces.
Figure 30:
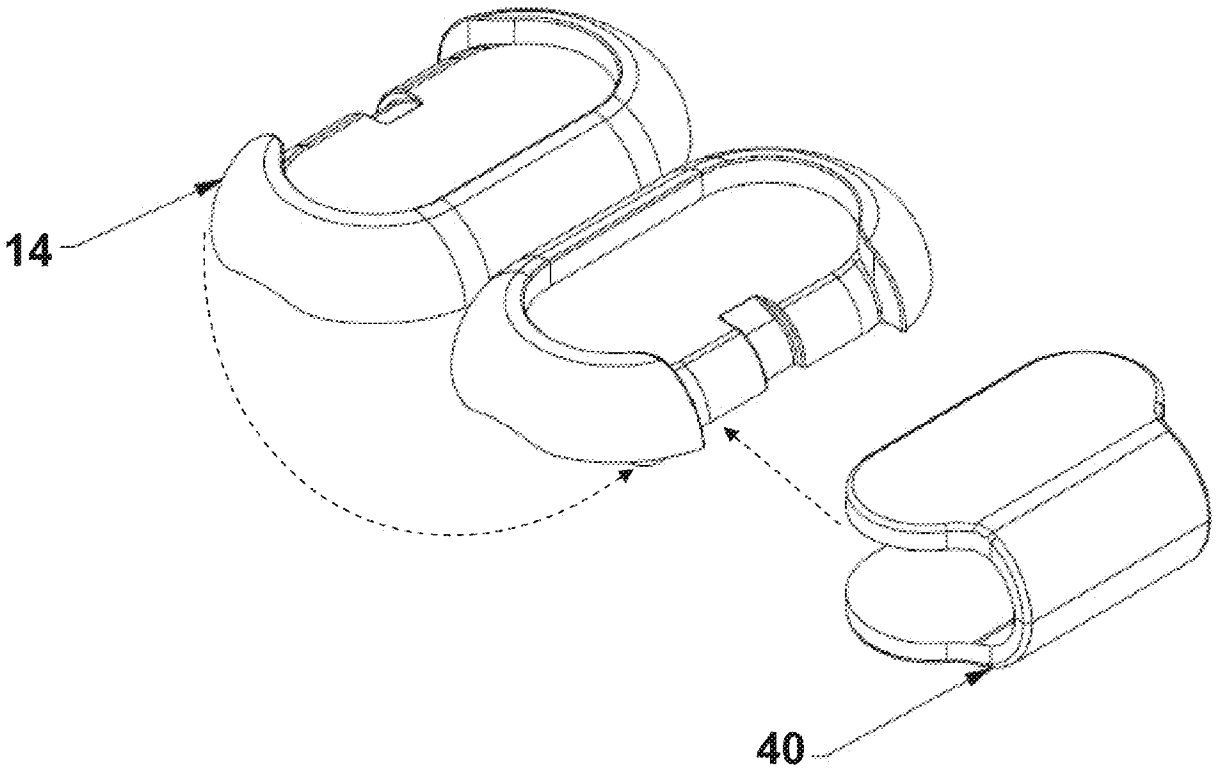
FIG. 30 is a schematic view of FIG. 1.

As shown in FIG. 7, when clip 40 is engaged with clamshell 20, hinge 16 remains physically accessible and is not covered or obscured. However, pivoting of hinge is substantially prevented due to clamshell being secured in closed position by clip 40. Recessed exterior 25 of clamshell (see FIG. 12) is sized and shaped to receive clip interior 42 of clip 40 (see FIG. 17) without unwanted gaps. These interlocking parts, coupled with rounded ends 14, create a streamlined shape, substantially a geometrical stadium in shape, which is easy to clean and is unlikely to catch wires in the vicinity.

It is preferred that clamshell recessed exterior 25 is textured, but clip interior 42 is non-textured. This allows clip 42 to slip into position, but provides frictional force to hold it in position. It is also desirable that clip exterior 41 is textured so as to provide a gripping surface when applying and removing clip from clamshell. As used herein "textured" could include a gripping surface such as rubberized plastic. It is also preferred that clamshell and/or clip are color coded or otherwise distinguishable such that a user or technician can easily differentiate between wires in a multi-wire environment.

FIGS. 19-30 set forth some preferred specifications including dimensions, tolerances and materials. It should be understood that these present the best mode contemplated, but other embodiments are within the scope of this invention.

Figure 31:
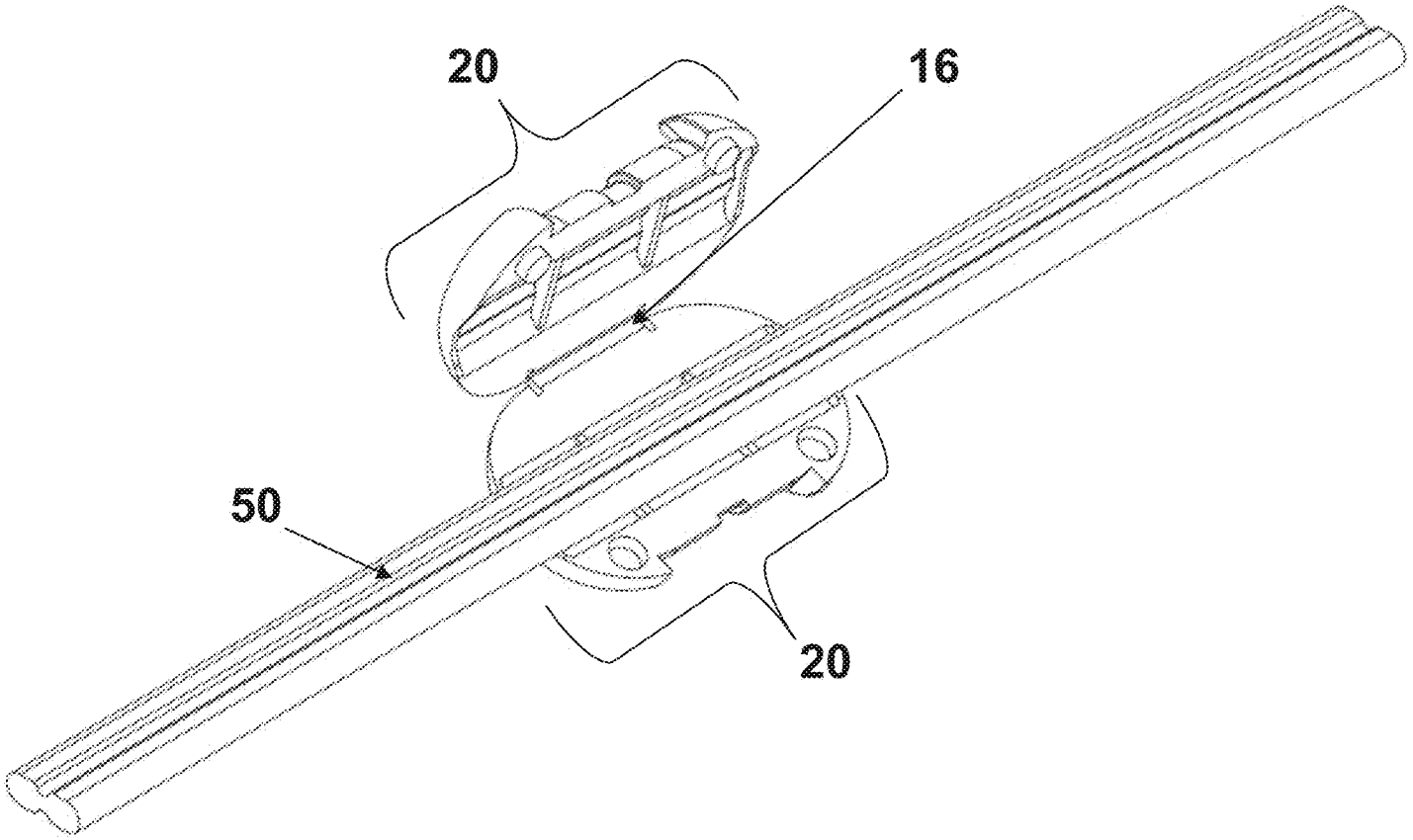
FIG. 31 is a perspective view of the clamshell in the open position with cords in place.

In use, a user such as a physical therapist or technician working in a multi-wire environment would isolate desired wire 50 and position a clamshell 20 around wire segment, as shown in FIG. 31. The clamshell would be closed by pivoting a first side relative to a second side at hinge 16. Then clip 40 would be positioned over clamshell 20, to form assembled identification system 10, as shown in FIG. 32. One or more identification systems may be assembled on the same wire so a user could visually distinguish one wire from another. Preferably different colored clamshells and/or clips would be employed, for example one wire has blue assemblies, another wire has red assemblies, and so forth.

It should be understood, of course, that the foregoing relates to exemplary embodiments of the invention and that modifications may be made without departing from the spirit and scope of the invention as set forth in the following claims. For example, the present invention could be adapted for use with computer wires, musical equipment wires, household appliance wires, etc. It should also be understood that ranges of values set forth inherently include those values, as well as all increments between. Finally, unless otherwise noted, or if contrary to common sense, all approximations shall be +/−5%.

What is claimed is:

1. A wire identification system comprising:

a. An oblong clamshell having a substantially planar first side joined to a substantially planar second side at a pivotable hinge, said first side defining a first recessed exterior having a depth, and said second side defining a second recessed exterior having a depth, said recessed exteriors substantially planar and parallel one to another; and b. A rigid clip having a thickness substantially similar to said depth, said clip releasably engaged with said first recessed exterior and said second recessed exterior along the non-hinged side of said clamshell thereby resulting in a substantially flush surface upon engagement that is substantially a geometrical stadium in shape, wherein said clip substantially prevents pivoting of said hinge.

2. The wire identification system of claim 1 wherein said clamshell defines a longitudinal cord channel.

3. The wire identification system of claim 2 wherein said channel includes semi-conformable material.

4. The wire identification system of claim 3 wherein said semi-conformable material is configured to frictionally secure a segment of wire.

5. The wire identification system of claim 1 wherein said first side includes an alignment protrusion, and said second side defines a corresponding alignment receiver.

6. The wire identification system of claim 1 wherein said substantially planar surface is substantially oblong.

7. The wire identification system of claim 6 wherein said clip obscures the substantially planar surface of said first side.

8. An improved electrical stimulation machine comprising:

a. A segment of wire;

b. A clamshell member surrounding said segment of wire, said clamshell member generally having an oblong perimeter with a hinged side, and two parallel substantially planar and recessed exterior surfaces each having a depth of recession;

c. A generally U-shaped clip having a thickness substantially similar to said depth of recession, and substantially parallel interiors, said clip engaged with said oblong member opposite said hinged side and at said exterior surfaces thereby obscuring said exterior surfaces, whereby said clamshell member and clip engage to create a substantially flush surface.

9. The improved electrical stimulation machine of claim 8 wherein the interior surface of said clip is substantially smooth.

10. The improved electrical stimulation machine of claim 9 wherein the exterior surface of said clip is substantially textured.

11. The improved electrical stimulation machine of claim 8 wherein said wire segment is substantially immobilized within said clamshell.

12. The improved electrical stimulation machine of claim 11 wherein said clamshell member forms a moisture-proof seal with said segment of wire.

13. The improved electrical stimulation machine of claim 8 wherein said clamshell is capable of repeated releasable engagements with said wire segment.

14. A method of differentiating wires in a multi-wire environment including the steps of:

a. Aligning a segment of wire along a cord channel of first side of an elongated clamshell device having substantially planar and recessed first and second sides separated by a hinge, said recessed sides having a recession depth;

b. Pivoting a second side relative to said first side of said clamshell device along said hinge to surround said segment of wire; and c. Engaging a securing clip around said clamshell device opposite said hinge to prevent pivoting of said hinge, wherein the thickness of said securing clip is substantially similar to said recession depth, and said securing clip includes two substantially parallel interiors, and whereby said engagement creates a substantially flush surface between said clamshell device and said securing clip, and is substantially a geometrical stadium in shape.

15. The method of claim 14 further including the step of selecting a visually distinctive securing clip.

16. The method of claim 14 further including the steps of disengaging said securing clip from said clamshell device, and removing said clamshell device from said segment of wire.

17. The method of claim 16 further including the steps of engaging said clamshell device and said securing clip on a different segment of wire.

* * * * *